US006737229B2

(12) United States Patent
Dannhauser et al.

(10) Patent No.: US 6,737,229 B2
(45) Date of Patent: May 18, 2004

(54) REVERSAL PHOTOGRAPHIC ELEMENT COMPRISING AN IMAGING LAYER CONTAINING IMAGING AND NON-IMAGE FORMING EMULSIONS

(75) Inventors: Thomas J. Dannhauser, Pittsford, NY (US); Keath T. Chen, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/197,917

(22) Filed: Jul. 18, 2002

(65) Prior Publication Data

US 2004/0013986 A1 Jan. 22, 2004

(51) Int. Cl.[7] ..... G03C 1/46
(52) U.S. Cl. ..... 430/504
(58) Field of Search ..... 430/504

(56) References Cited

U.S. PATENT DOCUMENTS

| | | | | |
|---|---|---|---|---|
| 4,082,553 | A | 4/1978 | Groet | |
| 4,400,463 | A | 8/1983 | Maskasky | 430/434 |
| 4,433,048 | A | 2/1984 | Solberg et al. | 430/434 |
| 4,434,226 | A | 2/1984 | Wilgus et al. | 430/567 |
| 4,435,501 | A | 3/1984 | Maskasky | 430/434 |
| 4,439,520 | A | 3/1984 | Kofron et al. | 430/434 |
| 4,554,245 | A | 11/1985 | Hayashi et al. | 430/567 |
| 4,614,707 | A | 9/1986 | Fujita et al. | 430/379 |
| 4,626,498 | A | 12/1986 | Shuto et al. | 430/379 |
| 4,656,122 | A | 4/1987 | Sowinski et al. | 430/505 |
| 4,752,558 | A | 6/1988 | Shimura et al. | 430/505 |
| 4,818,669 | A | 4/1989 | Ikeda et al. | 430/509 |
| 5,176,990 | A | 1/1993 | Kim | 430/509 |
| 5,262,287 | A | 11/1993 | Deguchi et al. | 430/504 |
| 5,266,448 | A | 11/1993 | Shuto et al. | 430/379 |
| 5,391,468 | A | 2/1995 | Cohen et al. | 430/503 |
| 5,552,265 | A | 9/1996 | Bredoux et al. | 430/379 |
| 5,567,579 | A | 10/1996 | Gourlaouen et al. | 430/567 |
| 5,631,123 | A | 5/1997 | Abe | 430/506 |
| 5,691,124 | A | 11/1997 | Kim et al. | 430/505 |
| 5,698,383 | A | 12/1997 | Pugh et al. | 430/505 |
| 5,830,628 | A | 11/1998 | Borst et al. | 430/506 |
| 5,876,914 | A | 3/1999 | Droin et al. | 430/567 |
| 5,932,401 | A | 8/1999 | Chen | 430/504 |
| 6,162,595 | A | 12/2000 | Chen | 430/504 |
| 6,329,132 | B1 | 12/2001 | Ihama | 430/569 |

FOREIGN PATENT DOCUMENTS

| | | |
|---|---|---|
| DE | 34 02 840 | 8/1984 |
| DE | 195 26 470 | 1/1997 |
| EP | 442 323 | 8/1991 |
| EP | 763 773 | 3/1997 |
| GB | 1 201 110 | 8/1970 |
| JP | 63-236034 | 10/1988 |
| JP | 1-166039 | 6/1989 |

*Primary Examiner*—Hoa Van Le
(74) *Attorney, Agent, or Firm*—Andrew J. Anderson

(57) ABSTRACT

A reversal photographic element comprising a support and, coated on said support, at least one image recording emulsion layer comprised of: a) a light sensitive silver halide imaging emulsion; and b) a non-image forming silver halide emulsion having an average grain size less than 0.3 $\mu$m and which comprises at least 13 percent of the total silver in the image recording layer, wherein the non-image forming silver halide emulsion comprises at least 1 mole percent iodide, and the iodide mole percentage of the non-image forming silver halide emulsion is equal to or higher than that of the imaging emulsion. The combination of the imaging emulsion and a higher iodide concentration non-imaging emulsion in an imaging layer gives an increase in interlayer interimage effects, increasing the color of the film.

20 Claims, No Drawings

REVERSAL PHOTOGRAPHIC ELEMENT COMPRISING AN IMAGING LAYER CONTAINING IMAGING AND NON-IMAGE FORMING EMULSIONS

FIELD OF THE INVENTION

This invention relates to improved photographic elements for producing reversal images. More specifically, this invention relates to reversal silver halide photographic elements containing an imaging layer comprising an imaging emulsion and a non-image forming emulsion having an equal or higher iodide concentration than the imaging emulsion.

BACKGROUND OF THE INVENTION

The term "reversal photographic element" designates a photographic element which produces a photographic image for viewing by being imagewise exposed and developed with a first non-chromogenic "black and white" developing agent to produce a negative of the image to be viewed, followed by uniform exposure and/or fogging of residual silver halide and processing to produce a second, viewable image. Such reversal elements are typically sold packaged with instructions to process using a color reversal process such as the Kodak E-6 process as described in The British Journal of Photography Annual of 1988, page 194. Color slides, such as those produced from Kodachrome® and Ektachrome® films, constitute a popular example of reversal photographic elements. In the overwhelming majority of applications the first image is negative and the second image is positive. Reversal photographic elements frequently comprise silver haloiodide imaging emulsions, where the term "silver haloiodide" is employed in its art recognized usage to designate silver halide grains containing silver ions in combination with iodide ions and at least one of chloride and bromide ions.

Groet U.S. Pat. No. 4,082,553 illustrates a conventional reversal photographic element containing a silver haloiodide grain emulsion modified by the incorporation of a small proportion of fogged silver halide grains. Hayashi et al German OLS No. 3,402,840 is similar to Groet, but describes the imaging silver halide grains in terms of those larger than and smaller than 0.3 micrometer and additionally requires in addition to the fogged silver halide grains or their metal or metal sulfide equivalent an organic compound capable of forming a silver salt of low solubility.

Tabular grain silver haloiodide emulsions have been recognized to provide a variety of photographic advantages, such as improvements in speed-granularity relationships, increased image sharpness, and reduced blue speed of minus blue recording emulsion layers. Tabular grain silver haloiodide emulsions in reversal photographic elements are illustrated by Research Disclosure Vol. 225, January 1983, Item 22534; Wilgus et al U.S. Pat. No. 4,434,226; Kofron et al U.S. Pat. No. 4,439,520; Solberg et al U.S. Pat. No. 4,433,048; Maskasky U.S. Pat. No. 4,400,463; and Maskasky U.S. Pat. No. 4,435,501. Research Disclosure is published by Kenneth Mason Publications, Ltd., The Old Harbourmaster's, 8 North Street, Emsworth, Hampshire P010 7DD, England.

U.S. Pat. No. 4,656,122 describes silver halide photographic elements capable of producing reversal images including one emulsion layer comprising a blend of tabular silver haloiodide grains and fine grains of a silver salt more soluble than silver iodide, which more soluble fine grains contain less iodide than the tabular grains. The addition of relatively fine grains consisting essentially of a silver salt more soluble than silver iodide to an image forming layer containing tabular silver haloiodide grains may produce a combination of advantages in reversal imaging. The reversal threshold speed of the reversal photographic elements can be increased. At the same time, reduced toe region density in the reversal image as well as increases in maximum density and contrast are observed. In U.S. Pat. No. 5,391,468, the addition of dye to high solubility fine grains which are added to an imaging emulsion layer such as taught in U.S. Pat. No. 4,656,122 to further improve speed and contrast is described. In U.S. Pat. No. 5,176,990, the dual melting of a fine grain emulsion such as taught in U.S. Pat. No. 4,656,122 with an imaging emulsion is described.

Blending of two or more imaging emulsions in image recording layer of photographic elements to obtain various desired photographic features is also well known. Blending of emulsions in color reversal photographic elements, e.g., is described in U.S. Pat. Nos. 5,876,914, 5,567,579, 4,554,245, EP 0 763 773, and JP01-166039A2.

Imaging dyes used in photographic materials generally have unwanted light absorption which reduce color saturation and may cause loss of color accuracy. Techniques for generating interimage effect (IE) upon photographic processing are known which will compensate such unwanted light absorption to a certain extent. A recent trend in photographic materials has led to the desire for increased color saturation in various applications. Therefore, techniques for providing more interimage effect are desirable.

U.S. Pat. Nos. 5,932,401 and 6,162,595 disclose reversal photographic element film structures which enhance interimage effect by combining a light sensitive imaging emulsion and a relatively large amount of one or more non-image forming fine grain emulsions in a substantially non-image forming special layer of the element. The use of very fine grain non-image forming emulsions (e.g., preferably less than 0.07 micrometer grain size) is taught as being preferred in the special layer in U.S. Pat. No. 5,932,401 to provide a relatively large surface area ratio relative to the imaging emulsion grain surface area to enhance interimage effects. Examples include the use of non-image forming emulsions which do and which do not include iodide. The use of a second larger non-image forming silver halide emulsion comprising iodide in combination with a smaller non-image forming emulsion in the special substantially non-image forming layer, or the use of a very polydisperse non-image forming silver halide emulsion comprising iodide in the special layer, is taught in U.S. Pat. No. 6,162,595 as being useful for further enhancing interimage effect in low density regions of a processed reversal element, relative to the effect achieved with a single non-image forming emulsion which is not very polydisperse at equal silver laydown.

While interimage effects may be increased for reversal elements when employing a special layer in accordance with U.S. Pat. Nos. 5,932,401 and 6,162,595, the requirement for an additional layer or layers adds to the complexity and cost of the photographic element. Additionally, it may be difficult to control the relative degree of color correction between various color records depending upon location of the special layer. Accordingly, it would be desirable to be able to increase interimage effects, especially in a relatively controllable manner, without the need for a separate special substantially non-forming layer.

SUMMARY OF THE INVENTION

In accordance with the invention, a reversal photographic element is disclosed comprising a support and, coated on said support, at least one image recording emulsion layer comprised of: a) a light sensitive silver halide imaging emulsion; and b) a non-image forming silver halide emulsion having an average grain size less than 0.3 μm and which comprises at least 13 percent of the total silver in the image recording layer, wherein the non-image forming silver halide emulsion comprises at least 1 mole percent iodide, and the iodide mole percentage of the non-image forming silver halide emulsion is equal to or higher than that of the imaging emulsion.

In preferred embodiments, the elements of the invention are multicolor photographic elements capable of forming a variable reversal dye image, and comprise a blue recording yellow dye image forming layer unit; a green recording magenta dye image forming layer unit, and a red recording cyan dye image forming layer unit. The combination of the imaging and non-image forming emulsions in at least one image forming layer of a reversal photographic element gives an increase in interlayer interimage effects, increasing the color of the element upon reversal photographic processing. In accordance with a particularly preferred embodiment wherein at least two image forming layers of the photographic element each comprise combinations of imaging and non-image forming emulsions in accordance with the invention, such increases in interlayer image effects may be obtained with less than expected increases in granularity.

DETAILED DESCRIPTION OF THE PREFERRED EMBODIMENTS

This invention relates to an improvement in silver halide reversal photographic elements. Photographic elements typically comprise imaging layers and non-imaging layers. Imaging layers could be red, green or blue light sensitive producing cyan, magenta and yellow dye in a subtractive color system. Non-imaging layers include AHU (antihalation undercoat), interlayer, overcoat layers for UV protection and anti-static layer. The red, green, or blue color records can be of any order, but multi-color photographic element typically have red, green, blue color records (in that order) above the support and interlayers in between color records. Typically a blue light filtration interlayer is added below the blue color record to reduce the blue light exposure of the green and red light sensitive emulsions. Similarly, a green light filtration interlayer may be added below the green color record to reduce the green light exposure of the red light sensitive emulsion. Each color record may contain several emulsions with varying light sensitivity. Each color record may also contain more than one layer, each layer may contain one or more than one type of imaging emulsion plus some non-imaging fine grain emulsions. The imaging emulsions used in the imaging layer(s) of the photographic element can be, for example, of conventional 3-dimensional morphology or, more preferably, of tabular grain morphology. The imaging emulsions can be of any type of halide composition. The imaging emulsions can be chemical and spectrally sensitized by any method known in the art. The layers of the same color records can be coated next to each other, or could be separated or interleaved with other color records. Oxidized developer (Dox) scavenger(s) are sometime employed either in the imaging emulsion layer or in a separate interlayer. These features are well understood by those skilled in the art.

In addition to a silver halide imaging emulsion, at least one image recording emulsion layer of the elements of the invention contains a non-image forming fine grain emulsion. The non-image forming fine grain emulsion comprises silver halide grains having an average grain size of less than 0.3 μm, more preferably from 0.02 to 0.15 μm, and most preferably from 0.05 to 0.1 μm. The non-image forming emulsion grain population must comprise at least 13 percent of the total silver in at least one image recording layer of elements of the invention, preferably from 13–70 percent, more preferably from 20–60 percent, and most preferably from 25–50 percent. Lower percentages of non-image forming emulsion typically will not provide the desired levels of interimage effect enhancement, while higher levels typically will not be required to provide the desired effect. While larger or smaller grains than the preferred sizes may be used, larger emulsion grains can lead to light scattering and degradation of sharpness, while smaller grains may require high laydowns of hydrophilic binder to avoid coating composition rheology issues in coating such relatively high percentages of fine grains.

The non-image forming emulsion also must contain at least 1 mole percent iodide, based on silver in the non-image forming emulsion, and the iodide percentage must be equal to or higher than the iodide concentration of the associated imaging emulsion. Thus, this invention is not directed towards providing the function of the fine grain emulsions as disclosed in U.S. Pat. No. 4,656,122, which require the fine grain emulsions to have a lower iodide concentration. Preferably, the iodide concentration of the non-image forming silver halide emulsion is from 1–15 mole percent, based on silver. The use of a relatively high percentage of fine grains comprising equal or higher iodide concentrations compared to the imaging emulsions in accordance with the invention has been found to advantageously result in obtaining enhanced interimage effects relative to the use of fine grains comprising a lower iodide concentration. The non-image forming emulsions can, for example, take the form of a relatively fine grain silver haloiodide emulsions, the preparations of which are well known to those skilled in the art and form no part of this invention. The relatively fine grain non-image forming emulsion population of grains can comprise, e.g., Lippmann, fine cubic emulsion, or fine tabular grain emulsions. So long as the grain size, silver percentage and relative iodide concentration requirements identified herein are satisfied, either or both of the imaging and non-image forming emulsions can themselves be the product of further conventional grain blending.

It is an important feature of the invention that the higher iodide concentration fine grain emulsion employed in the image recording layer comprise non-image forming grains. Such grains are incapable of forming a latent image extending the exposure latitude imparted to the layer by the imaging emulsion grains. When the imaging emulsion grains have received sufficient light exposure to reach their maximum level of developability, the non-image forming emulsion grain populations have not yet reached a threshold exposure for producing a latent image. The non-image forming emulsion grain populations need not be capable of forming a latent image at any level of exposure, since the latent image forming capability of such grain population is not utilized in enhancing reversal imaging characteristics. This is what is meant by "non-image forming". However, use of a fine grain population having a latent image forming capability is not excluded from the practice of the invention, provided its threshold exposure level is beyond the intended exposure latitude of the photographic element. Thus, the non-image forming emulsion grain populations preferably require at least 0.3 log E greater exposure than that required to bring the imaging emulsion grains of the element to a maximum level of developability. The relative insensitivity of the non-image forming emulsion grain populations to exposing radiation as compared to the imaging emulsion grains can result from the difference in their mean diameters, the imaging emulsion grains in most instances having the larger mean diameter. In most instances, and preferably, the difference in radiation sensitivity of the imaging and non-image forming emulsion grain populations is increased by chemically sensitizing and/or spectrally sensitizing only the imaging emulsion grains. Although not required, conventional techniques for desensitizing the non-image forming emulsion grain populations can, if desired, be employed. Zelikman et al Making and Coating Photographic Emulsions, Focal Press, 1964, pp. 234–237, illustrate the concept of extending exposure latitude.

It is generally most convenient to prepare the image forming layer required for the practice of this invention by blending an image forming emulsion, preferably after sensitization, and a separately prepared emulsion containing the relatively fine non-image forming emulsion grain populations.

In a preferred embodiment of the invention, an image forming layer is employed which comprises a blend of a tabular silver halide grain imaging emulsion and non-image forming fine grains having an iodide concentration higher than or equal to that of the tabular grain emulsion. Tabular grains are herein defined as those having two substantially parallel crystal faces, each of which is clearly larger than any other single crystal face of the grain, such that the ratio of the equivalent circular diameter of the major face of the grain to the grain thickness is at least 2. Where tabular grains are employed in a blended grain emulsion layer forming one or more layers of the reversal photographic elements of this invention, the tabular grain emulsion preferably comprises tabular grains having a thickness of less than 0.5 $\mu$m, an equivalent circular diameter of at least 0.3 $\mu$m, and an average aspect ratio of greater than 3:1 which account for at least 50 percent of the total grain projected area of the emulsion.

In general, tabular grains are preferred having a thickness of less than 0.3 $\mu$m. Where the emulsion layer is intended to record blue light as opposed to green or red light, it is advantageous to increase the thickness criterion of the tabular grains to less than 0.5 $\mu$m, instead of less than 0.3 $\mu$m. Such an increase in tabular grain thickness is also contemplated for applications in which the reversal image is to be viewed without enlargement or where granularity is of little importance, although these latter applications are relatively rare in reversal imaging, reversal images being most commonly viewed by projection. Tabular grain emulsions wherein the tabular grains have a thickness of less than 0.5 $\mu$m intended for recording blue light are disclosed by, e.g., Kofron et al U.S. Pat. No. 4,439,520, cited above.

While the tabular grains satisfying the 0.3 $\mu$m thickness criterion preferably account for at least 50 percent of the total projected area of the grains in tabular grain emulsions, it is appreciated that in blending a second grain population the tabular grain percentage of the total grain projected area may be decreased. Thus, it is apparent that while tabular grain emulsions are preferred for preparing blended grain emulsions and in a highly preferred form the blended grain emulsions are themselves tabular grain emulsions, this is not necessary in all instances, and departures can actually be advantageous for specific applications.

Preferred tabular grain silver halide emulsions for use as imaging emulsions in elements in accordance with the invention are those comprising silver haloiodide tabular grains having a thickness of less than 0.3 $\mu$m (optimally less than 0.2 $\mu$m). Such tabular emulsion grains further preferably have an average aspect ratio of at least 5:1 and optimally at least 8:1. The term "high aspect ratio tabular grain emulsion" is herein defined as requiring that tabular silver halide grains having a thickness of less than 0.3 $\mu$m and an average aspect ratio of greater than 8:1 account for at least 50 percent of the total projected area of the grains present in the emulsion. In a preferred form of the invention, silver halide grains satisfying the above thickness and diameter criteria account for at least 70 percent and optimally at least 90 percent of the total projected area of the silver halide grains. It is appreciated that the thinner the tabular grains accounting for a given percentage of the projected area, the higher the average aspect ratio of the emulsion. Typically the tabular grains have an average thickness of at least 0.03 $\mu$m, although even thinner tabular grains can in principle be employed.

High aspect ratio tabular grain emulsions useful in the practice of this invention can have extremely high average aspect ratios. Tabular grain average aspect ratios can be increased by increasing average grain diameters. This can produce sharpness advantages, but maximum average grain diameters are generally limited by granularity requirements for a specific photographic application. Tabular grain average aspect ratios can also or alternatively be increased by decreasing average grain thicknesses. When silver coverages are held constant, decreasing the thickness of tabular grains generally improves granularity as a direct function of increasing aspect ratio. Hence the maximum average aspect ratios of the tabular grain emulsions of this invention are a function of the maximum average grain diameters acceptable for the specific photographic application and the minimum attainable tabular grain thicknesses which can be conveniently produced. Maximum average aspect ratios have been observed to vary, depending upon the precipitation technique employed and the tabular grain halide composition. High aspect ratio tabular grain silver haloiodide emulsions with average aspect ratios of 100:1, 200:1, or even higher are obtainable by double-jet precipitation procedures. Tabular silver halide grain imaging emulsions may be provided by selecting from, e.g., the various tabular grain emulsions disclosed in Research Disclosure Vol. 225, January 1983, Item 22534; U.S. Pat. No. 4,434,226; U.S. Pat. No. 4,439,520; U.S. Pat. No. 4,433,048; U.S. Pat. No. 4,400,463; U.S. Pat. No. 4,435,501; U.S. Pat. No. 4,672,027 and U.S. Pat. No. 4,693,964.

Tabular haloiodide grains employed in preferred embodiments of this invention contain in addition to iodide at least one of bromide and chloride. Thus, the silver haloiodides specifically contemplated are silver bromoiodides, silver chlorobromoiodides, and silver chloroiodides. High bromide (i.e., grains having a bromide concentration of greater than 50 mole %, based on silver) silver haloiodide emulsions generally exhibit higher photographic speeds and are for this reason the preferred and most commonly employed emulsions for candid photography. Iodide is preferably present in the tabular silver haloiodide grains in a concentration sufficient to influence photographic performance. It is thus contemplated that at least about 0.5 mole percent iodide will be present in the tabular silver haloiodide grains. However, high levels of iodide are not required to achieve the advantages of this invention. Generally the tabular silver haloiodide grains contain less than 8 mole percent iodide. Preferred iodide levels in the tabular silver haloiodide grains are from 1 to 7 mole percent and optimally are from 2 to 6 mole percent. All of the above iodide mole percentages are based on total silver present in the tabular grains. Non-image forming emulsions which comprise fine silver bromoiodide grains having an iodide concentration of from 1–15 mole % are particularly preferred for use in combination with high bromide silver halide tabular grain imaging emulsions in the imaging layers of the elements of the invention.

The blended grain emulsions employed in imaging layers in accordance with preferred embodiments of the invention can be conveniently provided by blending with a tabular grain silver haloiodide imaging emulsion as described above a second non-image forming silver halide emulsion comprising fine silver halide grains having an equal or higher iodide concentration than the imaging emulsion.

The reversal photographic elements can take the form of either black-and-white or color reversal photographic elements. In a very simple form the reversal photographic elements according to this invention can be comprised of a conventional photographic support, such as a transparent film support, onto which is coated an imaging emulsion layer as described above. Following imagewise exposure, silver halide is imagewise developed to produce a first silver image, which need not be viewable. The first silver image can be removed by bleaching before further development when a silver or silver enhanced dye reversal image is desired. Thereafter, the residual silver halide is uniformly rendered developable by exposure or by fogging. Development produces a reversal image. The reversal image can be either a silver image, a silver enhanced dye image, or a dye image only, depending upon the specific choice of conventional processing techniques employed. The production of silver reversal images is described by Mason, Photographic Processing Chemistry, 1966. Focal Press Ltd., pp. 160–161. If a dye only image is being produced, silver bleaching is usually deferred until after the final dye image is formed.

The reversal photographic elements of this invention are preferably color reversal photographic elements capable of producing multicolor images—e.g., images that at least approximately replicate subject colors. Illustrative of such color reversal photographic elements are those disclosed by Kofron et al U.S. Pat. No. 4,439,520 and Groet U.S. Pat. No. 4,082,553, each cited above and here incorporated by reference. In a simple form such a color reversal photographic element can be comprised of a support having coated thereon at least three color forming layer units, including a blue recording yellow dye image forming layer unit, a green recording magenta dye image forming layer unit, and a red recording cyan dye image forming layer unit. Each color forming layer unit is comprised of at least one radiation sensitive silver halide emulsion layer. In a preferred form of the invention at least one radiation sensitive emulsion layer in at least one of the blue, green or red color forming layer units, and more preferably at least one radiation sensitive emulsion layer in each of two or more color forming layer units, is comprised of a combination of imaging and non-image forming emulsions as described above. The imaging emulsion in each color forming layer unit can be chemically and spectrally sensitized as taught by Kofton et al U.S. Pat. No. 4,439,520. In a preferred form chemical and spectral sensitization of the imaging emulsion is completed before blending with the second fine grain non-image forming emulsion, which therefore remains substantially free of sensitizing materials. One or more dye image providing materials, such as couplers, are preferably incorporated in each color forming layer unit, but can alternatively be introduced into the photographic element during processing.

In a typical construction, a reversal film is distinguished from a color negative film in that it does not have any masking couplers. Furthermore, reversal films have a gamma generally between 1.5 and 2.0, a gamma which is much higher than the gamma for typical negative materials.

The following constitutes a specific illustration of a color reversal photographic element according to a preferred embodiment of this invention.

I. Photographic Support

Exemplary preferred photographic supports include cellulose acetate, poly(ethylene terephthalate), and poly (ethylene naphthalate) film supports. Other possible supports include glass and photographic paper supports.

II. Subbing Layer

To facilitate coating on the photographic support it is preferred to provide a gelatin or other conventional subbing layer.

III. Red Recording Layer Unit

At least one layer comprised of a red sensitized imaging emulsion and a fine grain non-image forming emulsion, as described in detail above. In an emulsion layer or in a layer adjacent thereto at least one conventional cyan dye image forming coupler is included, such as, for example, one of the cyan dye image forming couplers disclosed in U.S. Pat. Nos. 2,423,730; 2,706,684; 2,725,292; 2,772,161; 2,772,162; 2,801,171; 2,895,826; 2,908,573; 2,920,961; 2,976,146; 3,002,836; 3,034,892; 3,148,062; 3,214,437; 3,227,554; 3,253,924; 3,311,476; 3,419,390; 3,458,315; and 3,476,563.

IV. Interlayer

At least one hydrophilic colloid interlayer, preferably a gelatin interlayer which includes a reducing agent, such as an aminophenol or an alkyl substituted hydroquinone, is provided to act as an oxidized developing agent scavenger.

V. Green Recording Layer Unit

At least one layer comprised of a green sensitized imaging emulsion and a fine grain non-image forming emulsion, as described in detail above. In an emulsion layer or in a layer adjacent thereto at least one conventional magenta dye image forming coupler is included, such as, for example, one of the magenta dye image forming couplers disclosed in U.S. Pat. Nos. 2,725,292; 2,772,161; 2,895,826; 2,908,573; 2,920,961; 2,933,391; 2,983,608; 3,005,712; 3,006,759; 3,062,653; 3,148,062; 3,152,896; 3,214,437; 3,227,554; 3,253,924; 3,311,476; 3,419,391; 3,432,521; and 3,519,429.

VI. Yellow Filter Layer

A yellow filter layer is provided for the purpose of absorbing blue light. The yellow filter layer can take any convenient conventional form, such as a gelatino-yellow colloidal silver layer (i.e., a Carey Lea silver layer) or a yellow dye containing gelatin layer. In addition the filter layer contains a reducing agent acting as an oxidized developing agent scavenger, as described above in connection with the Interlayer IV.

VII. Blue Recording Layer Unit

At least one layer comprised of a blue sensitized imaging emulsion and a fine grain non-image forming emulsion, as described in detail above. In an emulsion layer or in a layer adjacent thereto at least one conventional yellow dye image forming coupler is included, such, as, for example, one of the yellow dye image forming couplers disclosed in U.S. Pat. Nos. 2,875,057; 2,895,826; 2,908,573; 2,920,961; 3,148,062; 3,227,554; 3,253,924; 3,265,506; 3,277,155; 3,369,895; 3,384,657; 3,408,194; 3,415,652; and 3,447,928.

At least one additional inter or overcoat layer can be provided. Such layers are typically transparent gelatin layers and contain known addenda for enhancing coating, handling, and photographic properties, such as matting agents, surfactants, antistatic agents, ultraviolet absorbers, and similar addenda.

As disclosed by Kofron et al U.S. Pat. No. 4,439,520, high aspect ratio tabular grain emulsion layers show sufficient differences in blue speed and green or red speed when substantially optimally sensitized to green or red light that the use of a yellow filter layer is not required to achieve acceptable green or red exposure records. It is appreciated that in the absence of a yellow filter layer the color forming layer units can be coated in any desired order on the support. While only a single color forming layer unit is disclosed for recording each of the blue, green, and red exposures, it is appreciated that two, three, or even more color forming layer units can be provided to record any one of blue, green, and red. It is also possible to employ within any or all of the blue, green, and red color forming layer units any, some, or all image recording layers which satisfy the blended grain emulsion requirements of this invention.

In addition to the features described above the reversal photographic elements can, of course, contain other conventional features known in the art, which can be illustrated by reference to Research Disclosure, vol. 176, December 1978, Item 17643, here incorporated by reference. For example, the silver halide emulsions can be chosen from among those described in Paragraph I; the silver halide emulsions can be chemically sensitized, as described in Paragraph III and/or spectrally sensitized, as described in Paragraph IV, although preferably only the imaging silver halide emulsions are sensitized, with the preferred sensitizations those disclosed by Kofton et al U.S. Pat. No. 4,439,520 and Maskasky U.S. Pat. No. 4,435,501; any portion of the elements can contain brighteners, as described in Paragraph V; the emulsion layers can contain antifoggants and stabilizers, as described in Paragraph VI; the color forming layer units can contain color image forming materials as described in Paragraph VII; the elements can contain absorbing and scattering materials, as described in Paragraph VIII; the emulsion and other layers can contain vehicles, as described in Paragraph IX; the hydrophilic colloid and other layers of the elements can contain hardeners, as described in Paragraph X; the layers can contain coating aids, as described in Paragraph XI; the layers can contain plasticizers and lubricants, as described in Paragraph XII; the layers, particularly the layers coated farthest from the support, can contain matting agents, as described in Paragraph XVI; and the supports can be chosen from among those described in Paragraph XVII. In addition conventional time released or imagewise released inhibitors can be used such as those described in U.S. Pat. Nos. 5,567,577 and 3,379,529. This invention can be combined with development accelerators (e.g. Lanothane as described in U.S. Pat. No. 5,041,367), surface fogged emulsion, CLS (Carey Lea Silver), internally fogged emulsions or internally sensitized emulsions. This invention can be combined with the use of bleach accelerator releasing compound or a high efficiency coupler to reduce total Ag laydown. This exemplary listing of addenda and features is not intended to restrict or imply the absence of other conventional photographic features compatible with the practice of the invention.

The photographic elements can be imagewise exposed with any various forms of energy, as illustrated by Research Disclosure, Item 17643, cited above, Paragraph XVIII. This typically involves exposure to light in the visible region of the spectrum, and typically such exposure is of a live image through a lens. The photographic elements can be incorporated into exposure structures intended for repeated use or exposure structures intended for limited use, variously referred to as single use cameras, lens with film, or photosensitive material package units. However, reversal photographic elements of the present invention may alternatively be exposed in an electronic film writer. Exposure in a film writer is an exposure to a stored image (such as a computer stored image) by means of light emitting devices (such as light controlled by light valves, CRT, laser, laser diode, or some other controlled light source).

Silver halide color reversal films are typically associated with an indication for processing by a color reversal process. Reference to a film being associated with an indication for processing by a color reversal process, most typically means the film, its container, or packaging (which includes printed inserts provided with the film), will have an indication on it that the film should be processed by a color reversal process. The indication may, for example, be simply a printed statement stating that the film is a "reversal film" or that it should be processed by a color reversal process, or simply a reference to a known color reversal process such as "Process E-6" or "K-14". A "color reversal" process in this context is one employing a first developer treatment with a non-chromogenic developer (that is, a developer which will not imagewise produce color by reaction with other compounds in the film; sometimes referenced as a "black and white developer"). Black and white developing agents which may be used in the first development include dihydroxybenzenes or derivatives thereof, ascorbic acid or derivatives thereof, aminophenol and 3-pyrazolidone type developing agents. Such black and white developing agents are well known in the art, e.g., U.S. Pat. Nos. 5,187,050, 5,683,859, 5,702,875. Preferred non-chromogenic developers are hydroquinones (such as hydroquinone sulphonate). The non-chromogenic development is followed by fogging unexposed silver halide, usually either chemically or by exposure to light. Then the element is treated with a color developer which will produce color in an imagewise manner upon reaction with other compounds (couplers), which may be incorporated in the film or introduced during processing. A wide variety of different color reversal processes are well known in the art. For example, a single color developing step can be used when the coupling agents are incorporated in the photographic element or three separate color developing steps can be used in which coupling agents are included in the developing solutions.

The invention can be better appreciated by reference to the following specific examples, where a series of elements of the indicated layer structures are prepared. In the composition of the layers, the amounts coated are specified in $g/m^2$, except for silver halide emulsions which are described in $g/m^2$ of silver coated.

EXAMPLE 1

Element 1-1: A comparison photographic element was prepared as described below.

Layer 1: Antihalation Layer 0.25 Black colloidal silver 2.44 gelatin 0.06 UV dye UV-1 dispersed in 0.06 solvent SOL-1

0.06 UV dye UV-2 dispersed in 0.06 solvent SOL-1

Layer 2: Slow Cyan Layer 0.27 tabular silver iodobromide emulsion (4% bulk iodide, 0.30 $\mu$m diameter×0.13 $\mu$m thick, sensitized to red light with dyes SD-1, SD-2)

0.09 cyan coupler C-1 dispersed in
0.04 solvent SOL-2
0.83 gelatin
Layer 3: Mid Cyan Layer
0.44 tabular silver iodobromide emulsion (4% bulk iodide, 0.55 μm diameter×0.095 μm thick, sensitized to red light with dyes SD-1, SD-2)
0.51 cyan coupler C-1 dispersed in
0.25 solvent SOL-2
0.97 gelatin
Layer 4: Fast Cyan Layer
0.54 tabular silver iodobromide emulsion (3% bulk iodide, 1.0 μm diameter×0.10 μm thick, sensitized to red light with dyes SD-1, SD-2)
0.06 spherical silver iodobromide emulsion (4.8% bulk iodide, 0.15 μm diameter, sensitized with dye SD-1)
0.81 cyan coupler C-1 dispersed in
0.40 solvent SOL-2
1.41 gelatin
Layer 5: First Interlayer
0.06 filter dye FD-1
0.16 inhibitor INH-1 dispersed in
0.16 solvent SOL-4
0.81 gelatin
Layer 6: Slow Magenta Layer
0.37 tabular silver iodobromide emulsion (4% bulk iodide, 0.32 μm diameter×0.07 μm thick, sensitized to green light with dyes SD-3, SD-4)
0.06 magenta coupler M-1 dispersed in
0.06 solvent SOL-3
0.01 inhibitor INH-2 dispersed in
0.03 solvent SOL-4
0.74 gelatin
Layer 7: Mid Magenta Layer
0.36 tabular silver iodobromide emulsion (3% bulk iodide, 0.55 μm diameter×0.095 μm thick, sensitized to green light with dyes SD-3, SD-4)
0.27 magenta coupler M-1 dispersed in
0.27 solvent SOL-3
0.90 gelatin
Layer 8: Fast Magenta Layer
0.47 tabular silver iodobromide emulsion (3% bulk iodide, 1.0 μm diameter×0.10 μm thick, sensitized to green light with dyes SD-3, SD-4)
0.05 spherical silver iodobromide emulsion (4.8% bulk iodide, 0.15 μm diameter, sensitized to green light with dyes SD-3, SD-4)
0.61 magenta coupler M-1 dispersed in
0.61 solvent SOL-3
1.61 gelatin
Layer 9: Second Interlayer
0.11 filter dye FD-2
0.11 inhibitor INH-1 dispersed in
0.11 solvent SOL-4
0.81 gelatin
Layer 10: Slow Yellow Layer
0.19 tabular silver iodobromide emulsion (3% bulk iodide, 0.55 μm diameter×0.13 μm thick, sensitized to blue light with dyes SD-5, SD-6)
0.19 tabular silver iodobromide emulsion (3% bulk iodide, 0.95 μm diameter×0.13 μm thick, sensitized with dyes SD-5, SD-6)
0.89 yellow coupler Y-1 dispersed in
0.30 solvent SOL-5
1.24 gelatin hardener HAR-1 added at 1.38% total gelatin (by weight)
Layer 11: Fast Yellow Layer
0.60 tabular silver iodobromide emulsion (2% bulk iodide, 2.2 μm diameter×0.13 μm thick, sensitized to blue light with dyes SD-5, SD-6)
1.38 yellow coupler Y-1 dispersed in
0.46 solvent SOL-5
2.03 gelatin
Layer 12: First Overcoat
0.09 UV dye UV-1 dispersed in
0.36 latex polymer L-1
0.41 UV dye UV-3
0.06 inhibitor INH-1 dispersed in
0.06 solvent SOL-4
Layer 13: Top Overcoat
0.12 AgBr Lippmann emulsion (~0.05 μm diameter)
0.01 fogged fine grained cubic silver bromoiodide emulsion (0.06 μm edge length)
0.02 matte beads (~2 μm spherical diameter)
0.98 gelatin Definition of Components Used in Comparison Element 1-1

SOL-1: Hexanoic acid, 2-ethyl-, 1,4-cyclohexanediylbis (methylene) ester
SOL-2: 1,2-Benzenedicarboxylic acid, dibutyl ester
SOL-3: Dodecanamide, N,N-dibutyl-
SOL-4: Phosphoric acid, tris(methylphenyl) ester
SOL-5: Decanedioic acid, dibutyl ester
L-1: Butanoic acid, 3-oxo-, 2-((2-methyl-1-oxo-2-propenyl) oxy)ethyl ester, polymer with butyl 2-methyl-2-propenoate and 2-methyl-2-((1-oxo-2-propenyl)amino)-1-propanesulfonic acid monosodium salt
UV-1: Propanedinitrile, (3-(dihexylamino)-2-propenylidene)-
UV-2: 2-Propenoic acid, 2-cyano-3-(4-methoxyphenyl)-, propyl ester
UV-3: Tinuvin 171™ (Ciba-Geigy)
C-1: Hexanamide, 2-(2,4-bis(1,1-dimethylpropyl)phenoxy)-N-(4-((2,2,3,3,4,4,4-heptaflu oro-1-oxobutyl)amino)-3-hydroxyphenyl)-
M-1: Acetamide, N-(2-(7-chloro-6-(1,1-dimethylethyl)-1H-pyrazolo(5,1-c)-1,2,4-triazol-3-yl)-1,1,2-trimethylpropyl)-2-(2-((octylsulfonyl)amino)phenoxy)-
Y-1: Benzoic acid, 4-chloro-3-((2-(4-ethoxy-2,5-dioxo-3-(phenylmethyl)-1-imidazolidinyl)-4,4-dimethyl-1,3-dioxopentyl)amino)-, dodecyl ester
INH-1: Dodecanoic acid, 2-(4-((4-hydroxyphenyl)sulfonyl) phenoxy)-, 2-(4-(1-methylbutoxy)phenyl)hydrazide
INH-2: 2-(((((3-(10-Carboxydecyl)-1,4,5,6,7,8-hexahydro-1,4-dioxo-2-naphthalenyl) methyl)methylamino) carbonyl)thio)-4-thiazoleacetic acid, 4-methyl ester
FD-1: Benzoic acid, 4-(4-(3-(1-(4-carboxyphenyl)-1,5-dihydro-3-methyl-5-oxo-4H-pyrazol-4-ylidene)-1-propenyl)-5-hydroxy-3-methyl-1H-pyrazol-1-yl)-
FD-2: Methanesulfonamide, N-(4-(2-cyano-3-(1H-indol-3-yl)-1-oxo-2-propenyl)phenyl)-
SD-1: Benzothiazolium, 5-chloro-2-(2-((5-chloro-3-(2-oxo-2-((2-sulfoethyl)amino)ethyl)-2(3H)-benzothiazolylidene)methyl)-1-butenyl)-3-(2-oxo-2-((2-sulfoethyl)amino)ethyl)-, inner salt
SD-2: Benzothiazolium, 5-methyl-2-(2-((5-methyl-3-(3-sulfopropyl)-2(3H)-benzothiazolylidene)methyl)-1-butenyl)-3-(3-sulfopropyl)-, inner salt SD-3: Benzoxazolium, 5-chloro-2-(2-((5-chloro-3-(3-sulfopropyl)-2(3H)-benzoxazolylidene)methyl)-1-butenyl)-3-(3-sulfopropyl)-, inner salt SD-4: Benzoxazolium, 2-(2-((3-(2-carboxyethyl)-2(3H)-benzothiazolylidene)methyl)-1-butenyl)-5-chloro-3-(3-sulfopropyl)-, inner salt SD-5: Benzoxazolium, 5-phenyl-2-((4,5-dichloro-1-(3-sulfopropyl)-3-ethyl-2(1H)-benzimadzolylidene)methyl)-3-(3-sulfopropyl)-, inner salt SD-6: Benzothiazolium, 5-chloro-3-(3-sulfopropyl)-2-((3-(3-sulfopropyl)-2(3H)-benzothiazolylidene)methyl)-, inner salt HAR-1: Ethene, 1,1'-(methylenebis(sulfonyl))bis- Element 1-2 is a comparative photographic coating identical to element 1-1, except 0.32 g/m$^2$ undyed, unsensitized pure AgBr Lippmann emulsion (0.06 $\mu$m diameter) was added to the slow cyan (SC) layer.

Element 1-3 is an inventive photographic coating identical to element 1-1, except 0.32 g/m$^2$ of a fine-grained, unsensitized silver bromoiodide emulsion (emulsion HIF) was added to the slow cyan (SC) layer. The emulsion was a cubic morphology with an edge length of 0.06 $\mu$m and contained 5% iodide overall.

Element 1-4 is an inventive photographic coating identical to element 1-1, except 0.32 g/m$^2$ of the same unsensitized fine grained silver bromoiodide emulsion HIF was added to the mid cyan (MC) layer.

The step-flash interlayer interimage effect (IIE) measurement and procedure are the same as described in U.S. Pat. No. 5,932,401 and U.S. Pat. No. 4,082,553. The exposed coating strips were processed in a standard Kodak E-6 color reversal photographic process. The change in density of a color record of uniform exposure (the receiver) as modulated by the changing exposure of another color record (the causer) is described in terms of delta-D (delD) values. Thus, the metric delD is a measure of HIE response. The step-flash nomenclature describes the causer and receiver color records, i.e. RoG indicates exposure changes of a red causer record to effect density changes (delD) of a green receiver record. These delD density changes were measured for several different IIE receiver flash curves identified by their densities when the IIE causer exposures were at a minimum. The results are summarized in Table 1.

TABLE 1

| Element | Added fine grains, g/m$^2$ | delD at D = 1.0 | delD at D = 2.0 | step/flash |
|---|---|---|---|---|
| 1-1 comparison | none | 0.2 | 0.3 | RoG |
| 1-2 comparison | 0.32 LIPP(SC) | 0.26 | 0.33 | RoG |
| 1-3 invention | 0.32 HIF(SC) | 0.37 | 0.46 | RoG |
| 1-4 invention | 0.32 HIF(MC) | 0.45 | 0.5 | RoG |
| 1-1 comparison | none | 0.19 | 0.07 | GoR |
| 1-2 comparison | 0.32 LIPP(SC) | 0.08 | 0.07 | GoR |
| 1-3 invention | 0.32 HIF(SC) | 0.05 | −0.4 | GoR |
| 1-4 invention | 0.32 HIF(MC) | 0.04 | −0.48 | GoR |

The addition of silver iodobromide non-image forming fine-grained emulsions to the slow or mid cyan layers (elements 1-3 and 1-4, respectively) increases the amount of RoG IIE obtained relative to the comparison coating without any additional fine grain emulsion (element 1-1). Non-image forming 100% AgBr Lippmann emulsion added to the slow cyan layer (element 1-2) produced little or no increase in RoG IIE relative to element 1-1, in comparison to the RoG IIE increases observed when a 5% iodide fine-grain emulsion was added to the same cyan layer (element 1-3). In addition, elements 1-3 and 1-4 show a larger decrease in GoR IIE, especially at higher densities, in comparison to photographic elements without added fine-grain emulsions in the cyan layers (element 1-1), or those in which AgBr Lippmann emulsion is added to the cyan layer (element 1-2).

EXAMPLE 2

Element 2-1 is a comparative photographic coating made in the same manner as element 1-1.

Element 2-2 is an invention photographic coating identical to element 2-1 except 0.16 g/m$^2$ of the HIF emulsion described in example 1 was added to the mid magenta (MM) layer.

Element 2-3 is an invention photographic coating identical to element 2-1 except 0.32 g/m$^2$ of the HIF emulsion described in example 1 was added to the mid magenta (MM) layer.

Element 2-4 is an invention photographic coating identical to element 2-1 except 0.32 g/m$^2$ of the HIF emulsion described in example 1 was added to the mid cyan (MC) layer.

Table 2 summarizes the IIE delta-D measurements of example 2.

TABLE 2

| Element | Added fine grains, g/m$^2$ | delD at D = 0.5 | delD at D = 1.0 | delD at D = 1.5 | delD at D = 2.0 | step/flash |
|---|---|---|---|---|---|---|
| 2-1 comparison | none | 0.12 | 0.16 | 0.27 | 0.26 | RoG |
| 2-2 invention | 0.16 HIF(MM) | 0.09 | −0.03 | −0.01 | 0.02 | RoG |
| 2-3 invention | 0.32 HIF(MM) | 0.03 | −0.06 | −0.16 | −0.2 | RoG |
| 2-4 invention | 0.32 HIF(MC) | 0.31 | 0.38 | 0.48 | 0.43 | RoG |
| 2-1 comparison | none | 0.23 | 0.24 | 0.2 | 0.15 | GoR |
| 2-2 invention | 0.16 HIF(MM) | 0.43 | 0.37 | 0.29 | 0.22 | GoR |
| 2-3 invention | 0.32 HIF(MM) | 0.46 | 0.39 | 0.27 | 0.2 | GoR |
| 2-4 invention | 0.32 HIF(MC) | 0.13 | 0.05 | 0.03 | 0.02 | GoR |
| 2-1 comparison | none | 0.16 | 0.22 | 0.2 | 0.15 | RoB |
| 2-2 invention | 0.16 HIF(MM) | 0.13 | 0.09 | 0.06 | 0.04 | RoB |
| 2-3 invention | 0.32 HIF(MM) | 0.09 | 0.08 | 0.04 | 0.02 | RoB |
| 2-4 invention | 0.32 HIF(MC) | 0.29 | 0.35 | 0.33 | 0.26 | RoB |
| 2-1 comparison | none | 0 | −0.08 | −0.14 | −0.22 | GoB |
| 2-2 invention | 0.16 HIF(MM) | 0.12 | 0.06 | −0.05 | −0.15 | GoB |
| 2-3 invention | 0.32 HIF(MM) | 0.19 | 0.15 | 0.06 | −0.05 | GoB |
| 2-4 invention | 0.32 HIF(MC) | −0.07 | −0.19 | −0.3 | −0.38 | GoB |

Example 2 demonstrates that addition of fine-grained non-image forming emulsions in an imaging emulsion layer results in that color record becoming a more effective IIE causer, but simultaneously a poorer IIE receiver. Addition of the non-image forming HIF emulsion to the mid-magenta increases GoR and decreases RoG IIE relative to the comparison element 2-1 lacking the added fine-grain emulsion. Increasing laydowns of HIF in the mid-magenta causes the RoG IIE to further decrease and GoB to additionally increase. When HIF is added to the mid-cyan layer (element 2-4) instead of the mid-magenta layer (element 2-3), opposite changes (relative to element 2-1) in RoG and GoR IIE are obtained. The addition of the HIF to the mid-cyan layer also cause an increase in RoB IIE relative to the comparison element 2-1, while HIF addition to the mid-magenta layer causes an increases in GoB IIE.

EXAMPLE 3

Comparison Element 3-1 is described below. The format is the same used for the description of element 1-1.

Layer 1: Antihalation Layer 0.25 Black colloidal silver 2.44 gelatin 0.06 UV dye UV-1 dispersed in 0.06 solvent SOL-1

0.06 UV dye UV-2 dispersed in 0.06 solvent SOL-1

Layer 2: Slow Cyan Layer 0.27 tabular silver iodobromide emulsion (4% bulk iodide, 0.30 μm diameter×0.13 μm thick, sensitized to red light with dyes SD-1, SD-2)

0.09 cyan coupler C-1 dispersed in 0.04 solvent SOL-1

0.83 gelatin

Layer 3: Mid Cyan Layer 0.44 tabular silver iodobromide emulsion (4% bulk iodide, 0.55 μm diameter×0.095 μm thick, sensitized to red light with dyes SD-1, SD-2)

0.51 cyan coupler C-1 dispersed in 0.25 solvent SOL-1

0.97 gelatin

Layer 4: Fast Cyan Layer 0.54 tabular silver iodobromide emulsion (3% bulk iodide, 1.0 μm diameter×0.10 μm thick, sensitized to red light with dyes SD-1, SD-2)

0.06 spherical silver iodobromide emulsion (4.8% bulk iodide, 0.15 μm diameter, sensitized with dye SD-1)

0.81 cyan coupler C-1 dispersed in 0.40 solvent SOL-1

1.41 gelatin

Layer 5: First interlayer 0.06 filter dye FD-1

0.16 inhibitor INH-1 dispersed in 0.16 solvent SOL-4

0.81 gelatin

Layer 6: Slow Magenta Layer 0.37 tabular silver iodobromide emulsion (4% bulk iodide, 0.32 μm diameter×0.07 μm thick, sensitized to green light with dyes SD-3, SD-4)

0.01 surface-fogged cubic silver bromoiodide emulsion (0.06 μm edge length, 5% bulk iodide)

0.07 magenta coupler M-2 and 0.03 magenta coupler M-3 dispersed in 0.05 solvent SOL-4

0.01 inhibitor INH-2 dispersed in 0.03 solvent SOL-4

0.74 gelatin

Layer 7: Mid Magenta Layer 0.36 tabular silver iodobromide emulsion (3% bulk iodide, 0.55 μm diameter×0.095 μm thick, sensitized to green light with dyes SD-3, SD-4)

0.32 magenta coupler M-2 and 0.14 magenta coupler M-3 dispersed in 0.23 solvent SOL-4

0.90 gelatin

Layer 8: Fast Magenta Layer 0.55 tabular silver iodobromide emulsion (3% bulk iodide, 1.0 μm diameter×0.10 μm thick, sensitized to green light with dyes SD-3, SD-4)

0.06 spherical silver iodobromide emulsion (4.8% bulk iodide, 0.15 μm diameter)

0.74 magenta coupler M-2 and 0.32 magenta coupler M-3 dispersed in 0.53 solvent SOL-4

1.78 gelatin

Layer 9: Second Interlayer 0.11 filter dye FD-2

0.01 Carey Lea silver 0.11 inhibitor INH-1 dispersed in 0.11 solvent SOL-4

0.81 gelatin

Layer 10: Slow Yellow Layer 0.38 tabular silver iodobromide emulsion (3% bulk iodide, 0.55 μm diameter×0.13 μm thick, sensitized to blue light with dyes SD-5, SD-6)

0.89 yellow coupler Y-1 dispersed in 0.30 solvent SOL-5

1.24 gelatin hardener HAR-1 added at 1.38% total gelatin (by weight)

Layer 11: Fast Yellow Layer 0.30 tabular silver iodobromide emulsion (2% bulk iodide, 2.2 μm diameter×0.13 μm thick, sensitized to blue light with dyes SD-5, SD-6)

0.30 tabular silver iodobromide emulsion (3% bulk iodide, 0.95 μm diameter×0.13 μm thick, sensitized with dyes SD-5, SD-6)

1.38 yellow coupler Y-1 dispersed in 0.46 solvent SOL-5

2.03 gelatin

Layer 12: First Overcoat 0.09 UV dye UV-1 dispersed in 0.36 latex polymer L-1

0.41 UV dye UV-3

0.06 inhibitor INH-1 dispersed in 0.06 solvent SOL-4

Layer 13: Top Overcoat 0.12 AgBr Lippmann emulsion (~0.05 μm diameter)

0.01 surface-fogged cubic silver bromoiodide emulsion (0.06 μm edge length, 5% bulk iodide)

0.02 matte beads (~2 μm spherical diameter)

0.98 gelatin

Definition of Example 3 Components Not Previously Specified

M-2: Benzoic acid, 4-(4-(3-(1-(4-carboxyphenyl)-1,5-dihydro-3-methyl-5-oxo-4H-pyrazol-4-ylidene)-1-propenyl)-5-hydroxy-3-methyl-1H-pyrazol-1-yl)-

M-3: Benzamide, 3-((2-(2,4-bis(1,1-dimethylpropyl) phenoxy)-1-oxobutyl)amino)-N-(4,5-d ihydro-5-oxo-1-(2,4,6-trichlorophenyl)-1H-pyrazol-3-yl)-

Element 3-2 is an inventive photographic coating identical to element 3-1 except 0.16 g/m$^2$ of a fine-grained, unsensitized silver bromoiodide emulsion (emulsion HIF described in Example 1) was added to the mid magenta (MM) layer and 0.2 mg/m$^2$ of inhibitor INH-3 (4-Thiazoleacetic acid, 2,3-dihydro-2-thioxo-) was added to the slow cyan (SC) layer.

Element 3-3 is an inventive photographic coating identical to element 3-2 except 0.16 g/m$^2$ of a fine-grained, unsensitized silver bromoiodide emulsion (emulsion HIF) was added to the mid cyan (MC) layer.

Element 3-4 is an inventive photographic coating identical to element 3-2 except 0.32 g/m$^2$ of a fine-grained, unsensitized silver bromoiodide emulsion (emulsion HIF) was added to the mid cyan (MC) layer.

Table 3 below summarizes the IIE delta-D measurements for example 3.

TABLE 3

| Element | Added fine grains, g/m$^2$ | delD at D = 0.5 | delD at D = 1.0 | delD at D = 1.5 | delD at D = 2.0 | step/flash |
|---|---|---|---|---|---|---|
| 3-1 comparison | none | 0.14 | 0.17 | 0.25 | 0.3 | RoG |
| 3-2 invention | 0.16 HIF(MM) | 0.22 | 0.23 | 0.15 | 0.11 | RoG |
| 3-3 invention | 0.16 HIF(MM) 0.16 HIF(MC) | 0.4 | 0.37 | 0.26 | 0.17 | RoG |
| 3-4 invention | 0.16 HIF(MM) 0.32 HIF(MC) | 0.5 | 0.46 | 0.37 | 0.31 | RoG |
| 3-1 comparison | none | 0.18 | 0.22 | 0.22 | 0.21 | RoB |
| 3-2 invention | 0.16 HIF(MM) | 0.18 | 0.17 | 0.15 | 0.14 | RoB |
| 3-3 invention | 0.16 HIF(MM) 0.16 HIF(MC) | 0.24 | 0.19 | 0.16 | 0.15 | RoB |
| 3-4 invention | 0.16 HIF(MM) 0.32 HIF(MC) | 0.24 | 0.21 | 0.19 | 0.2 | RoB |
| 3-1 comparison | none | 0.22 | 0.18 | 0.12 | 0.08 | GoR |
| 3-2 invention | 0.16 HIF(MM) | 0.52 | 0.43 | 0.31 | 0.23 | GoR |
| 3-3 invention | 0.16 HIF(MM) 0.16 HIF(MC) | 0.5 | 0.42 | 0.31 | 0.21 | GoR |
| 3-4 invention | 0.16 HIF(MM) 0.32 HIF(MC) | 0.43 | 0.27 | 0.15 | 0.07 | GoR |
| 3-1 comparison | none | 0.16 | 0.18 | 0.13 | 0.05 | GoB |
| 3-2 invention | 0.16 HIF(MM) | 0.24 | 0.29 | 0.24 | 0.17 | GoB |
| 3-3 invention | 0.16 HIF(MM) 0.16 HIF(MC) | 0.25 | 0.27 | 0.2 | 0.11 | GoB |
| 3-4 invention | 0.16 HIF(MM) 0.32 HIF(MC) | 0.22 | 0.21 | 0.14 | 0.05 | GoB |

The addition of the unsensitized fine-grained emulsion (HIF) to the mid magenta (MM) layer (element 3-2) generates increased GoR and GoB IIE relative to element 3-1. Subsequent addition of the same non-image forming emulsion to the mid cyan (MC) layer (element 3-3) causes the RoG IIE to be increased significantly beyond the level obtained by element 3-2. Surprisingly, the high GoR IIE terms obtained due to the original addition of the non-image forming fine-grained emulsion to the mid-magenta (MM) layer are maintained. When a still higher level of fines is added to the mid-cyan (MC) layer (element 3-4), the RoG IIE is further increased while GoR IIE is decreased relative to element 3-3. However, both the RoG and GoR IIE as measured at receiver flashes of lower densities are increased relative to the same IIE terms of the comparison coating lacking the addition of the non-image forming fine grains to the mid cyan (MC) and mid magenta (MM) layers (element 3-4 relative to element 3-1). Example 3 therefore demonstrates the surprising additive nature of IIE resulting from the blending of fine-grained non-image forming emulsions in different imaging layers of a reversal photographic element. In addition, by varying the relative laydowns and locations of the blended fines, IIE obtained in the film and its resulting color reproduction can be controlled.

The granularities of the invention elements 2-2, 2–3, and 2-4 (wherein a fine grain non-image forming emulsion is added to a single imaging emulsion layer) relative to comparison element 2-1, and the granularities of the invention elements 3-3 and 3-4 (wherein a fine grain non-image forming emulsion is added to two imaging emulsion layers in accordance with a preferred embodiment of the invention) relative to comparison element 3-1 were evaluated and are reported in Table 4 below. These are expressed as a change in granularity units (ΔGU) calculated according to the equation below:

$$\Delta GU = \text{Log}\,(\sigma/\sigma')/\text{Log}(1.05)$$

in which σ is the RMS granularity of the invention element coating and σ' is the RMS granularity of the comparison element coating, both measured at D=1.0. RMS granularity is an expression of density fluctuation or noise, and is measured by means of granulometer with a 48 μm aperture under the densitometry conditions defined by the standard ANSI-PH2-19-1976. A 1.0 value of ΔGU is a 5% change in granularity, which approximately corresponds to a just-noticeable difference in perceived graininess (T. H. James, Theory of the Photographic Process, 4$^{th}$ edition, p.621).

TABLE 4

| Element | Added fine grains, g/m$^2$ | Red granularity (ΔGU) | Green granularity (ΔGU) |
|---|---|---|---|
| 2-1 comparison | none | 0 | 0 |
| 2-2 invention | 0.16 HIF(MM) | 1.6 | −2.3 |
| 2-3 invention | 0.32 HIF(MM) | 5.1 | −0.9 |
| 2-4 invention | 0.32 HIF(MC) | −1.9 | 3.1 |
| 3-1 comparison | none | 0 | 0 |
| 3-3 invention | 0.16 HIF(MM) & 0.16 HIF(MC) | 0.2 | 0.9 |
| 3-4 invention | 0.16 HIF(MM) & 0.32 HIF(MC) | 0.2 | 1.1 |

Comparison of Table 2 to Table 4 shows the granularity of a color record may significantly increase with its increasing IIE receivability for elements with a single emulsion layer having the blended fines in accordance with one embodiment of the invention. For example, element 2-4 in which fines are blended in a red-light sensitive (cyan) causer layer, both the on-green receiver IIE and green granularity are increased relative to the comparative element 2-1 lacking the blended fines. Similarly, when the HIF emulsion is instead added only to a green-light sensitive (magenta) causer as in elements 2-2 and 2-3, the on-red receiver IIE and red granularity are both increased. Surprisingly, however, with the blending of the fine-grained non-image forming emulsion in both cyan and magenta layers (elements 3-3 and 3-4) in accordance with a preferred embodiment of the invention, both the RoG and GoR IIE are advantageously increased relative to the same IIE terms of the comparison coating (element 3-1) as described above, with little change in granularity relative to the comparison element lacking these blended fines.

While the invention has been described with particular reference to a preferred embodiment, it will be understood by those skilled in the art the various changes can be made and equivalents may be substituted for elements of the preferred embodiment without departing from the scope of the invention.

We claim:

1. A reversal photographic element comprising a support and, coated on said support, a red light recording cyan dye image forming layer unit, a green light recording magenta dye image forming layer unit, and a blue light recording yellow dye image forming layer unit, each image forming layer unit comprising at least one radiation sensitive silver halide image recording emulsion layer, wherein at least one image recording emulsion layer of at least one image forming layer unit is comprised of:

a) a light sensitive silver halide imaging emulsion; and b) a non-image forming silver halide emulsion having an average grain size less than 0.3 $\mu$m and which comprises at least 13 percent of the total silver in the image recording layer, wherein the non-image forming silver halide emulsion comprises at least 1 mole percent iodide, and the iodide mole percentage of the non-image forming silver halide emulsion is equal to or higher than that of the imaging emulsion.

2. The element of claim 1, wherein the at least one image recording emulsion layer of at least one image forming layer unit is a component of the red light recording cyan dye image forming layer unit.

3. The element of claim 1, wherein the at least one image recording emulsion layer of at least one image forming layer unit is a component of the green light recording magenta dye image forming layer unit.

4. The element of claim 1, wherein the at least one image recording emulsion layer of at least one image forming layer unit is a component of the blue light recording yellow dye image forming layer unit.

5. The element of claim 1, wherein at least two of the image forming layer units each comprise at least one image recording emulsion layer comprised of a light sensitive silver halide imaging emulsion and a non-image forming silver halide emulsion having an average grain size less than 0.3 $\mu$m which comprises at least 13 percent of the total silver in the image recording layer, wherein the non-image forming silver halide emulsion comprises at least 1 mole percent iodide, and the iodide mole percentage of the non-image forming silver halide emulsion is equal to or higher than that of the imaging emulsion in the image recording emulsion layer.

6. The element of claim 5, wherein each of the red light recording cyan dye image forming layer unit and the a green light recording magenta dye image forming layer unit comprise at least one image recording emulsion layer comprised of a light sensitive silver halide imaging emulsion and a non-image forming silver halide emulsion having an average grain size less than 0.3 $\mu$m which comprises at least 13 percent of the total silver in the image recording layer, wherein the non-image forming silver halide emulsion comprises at least 1 mole percent iodide, and the iodide mole percentage of the non-image forming silver halide emulsion is equal to or higher than that of the imaging emulsion in the image recording emulsion layer.

7. The element of claim 1, wherein the imaging emulsion comprises a tabular grain emulsion.

8. The element of claim 7, wherein the tabular grain emulsion comprises a silver haloiodide emulsion comprising at least 0.5 mole percent iodide, based on total silver of the emulsion.

9. The element of claim 8, wherein the tabular grain emulsion comprises a high bromide silver haloiodide emulsion.

10. The element of claim 9, wherein the non-image forming emulsion comprises a silver bromoiodide emulsion comprising from 1–15 mole % iodide, based on silver.

11. The element of claim 10, wherein the average grain size of the non-image forming emulsion is from 0.02 to 0.15 $\mu$m.

12. The element of claim 11, wherein the average grain size of the non-image forming emulsion is from 0.05 to 0.10 $\mu$m.

13. The element of claim 12, wherein the non-image forming emulsion comprises from 13–70 percent of the total silver in the image recording layer.

14. The element of claim 13, wherein the non-image forming emulsion comprises from 20–60 percent of the total silver in the image recording layer.

15. The element of claim 14, wherein the non-image forming emulsion comprises from 25–50 percent of the total silver in the image recording layer.

16. The element of claim 1, wherein the non-image forming silver halide emulsion comprises from 1–15 mole % iodide, based on silver.

17. The element of claim 1, wherein the average grain size of the non-image forming emulsion is from 0.02 to 0.15 $\mu$m.

18. The element of claim 1, wherein the non-image forming emulsion comprises from 13–70 percent of the total silver in the image recording layer.

19. The element of claim 18, wherein the non-image forming emulsion comprises from 20–60 percent of the total silver in the image recording layer.

20. The element of claim 19, wherein the non-image forming emulsion comprises from 25–50 percent of the total silver in the image recording layer.

* * * * *